US010605236B2

(12) United States Patent
Guender

(10) Patent No.: US 10,605,236 B2
(45) Date of Patent: Mar. 31, 2020

(54) ELECTROHYDRAULIC COMPACT ASSEMBLY

(71) Applicant: Robert Bosch GmbH, Stuttgart (DE)

(72) Inventor: Andreas Guender, Ramsthal (DE)

(73) Assignee: Robert Bosch GmbH, Stuttgart (DE)

( * ) Notice: Subject to any disclaimer, the term of this patent is extended or adjusted under 35 U.S.C. 154(b) by 71 days.

(21) Appl. No.: 15/764,106

(22) PCT Filed: Sep. 21, 2016

(86) PCT No.: PCT/EP2016/072344
§ 371 (c)(1),
(2) Date: Mar. 28, 2018

(87) PCT Pub. No.: WO2017/055145
PCT Pub. Date: Apr. 6, 2017

(65) Prior Publication Data

US 2018/0274526 A1 Sep. 27, 2018

(30) Foreign Application Priority Data

Oct. 2, 2015 (DE) ..... 10 2015 219 091

(51) Int. Cl.

| | |
|---|---|
| ***F04B 17/03*** | (2006.01) |
| ***F04B 23/02*** | (2006.01) |
| ***F04B 53/08*** | (2006.01) |
| ***F04B 53/16*** | (2006.01) |
| ***F15B 21/044*** | (2019.01) |
| *F15B 21/042* | (2019.01) |

(52) U.S. Cl.
CPC ..... *F04B 17/03* (2013.01); *F04B 23/021* (2013.01); *F04B 53/08* (2013.01); *F04B 53/16* (2013.01); *F15B 21/044* (2013.01); *F15B 21/042* (2013.01)

(58) Field of Classification Search
CPC ..... F04B 17/03; F04B 23/025; F04B 23/026
See application file for complete search history.

(56) References Cited

U.S. PATENT DOCUMENTS 3,897,178 A * 7/1975 Palloch ..... F04D 13/06 417/368
4,627,793 A * 12/1986 Kuroyanagi ..... F04B 17/03 417/203

(Continued)

FOREIGN PATENT DOCUMENTS

| | | |
|---|---|---|
| DE | 196 52 706 A1 | 6/1997 |
| EP | 0 574 714 A2 | 12/1993 |
| EP | 0 857 871 A1 | 8/1998 |

OTHER PUBLICATIONS

International Search Report corresponding to PCT Application No. PCT/EP2016/072344 dated Nov. 24, 2016 (German and English language document) (6 pages).

(Continued)

*Primary Examiner* — Thomas E Lazo
(74) *Attorney, Agent, or Firm* — Maginot, Moore & Beck LLP

(57) ABSTRACT

A hydrostatic compact assembly includes an electric motor, a tank, and a pump. The pump is configured to deliver a pressure fluid from the tank to a consumer connection. The tank has a circular ring-like shape that surrounds the electric motor and the pump.

12 Claims, 3 Drawing Sheets

(56) References Cited

U.S. PATENT DOCUMENTS

| | | | | |
|---|---|---|---|---|
| 4,875,836 | A * | 10/1989 | Zehnder | F04D 29/606 417/360 |
| 5,181,838 | A * | 1/1993 | Sato | B60S 1/481 417/360 |
| 5,542,823 | A * | 8/1996 | de Jong | F04B 17/03 417/273 |
| 6,942,468 | B2 * | 9/2005 | Sauerbier | F04B 17/03 417/234 |
| 9,745,974 | B2 * | 8/2017 | Phillips | F04B 49/06 |
| 2015/0125323 | A1 | 5/2015 | Stair et al. | |

OTHER PUBLICATIONS

Rexroth Bosch Group; Modular standard power units, Type ABSKG; RE 51013, Edition 11.14; 32 Pages; Bosch Rexroth AG.
Rexroth Bosch Group; Clamping and drive module, Type UPE 2; RE51142/05.13; 12 Pages; Bosch Rexroth AG.
Rexroth Bosch Group; Drive module, Type UPE 5; RE51145/06.12; 16 Pages; Bosch Rexroth AG.

* cited by examiner

ELECTROHYDRAULIC COMPACT ASSEMBLY

This application is a 35 U.S.C. § 371 National Stage Application of PCT/EP2016/072344, filed on Sep. 21, 2016, which claims the benefit of priority to Serial No. DE 10 2015 219 091.9, filed on Oct. 2, 2015 in Germany, the disclosures of which are incorporated herein by reference in their entirety.

The disclosure relates to a compact electrohydraulic assembly. Assemblies of said type have an electric motor and a pump which delivers pressure medium from a tank to a hydrostatic consumer which is connected to the compact assembly.

BACKGROUND

The applicant's printed data sheet "Modular standard power units Type ABSKG", number RE 51013, edition: 11.14, discloses an electrohydraulic, modular assembly in which, for example, a motor, pump, filter, etc. can be varied and combined in a simple manner. The use of standard products makes the concept cost-effective if high variation in the arrangement of components is required.

The outlay in terms of mounting, for example in the case of the pipework, is high for the assembly. If a large quantity of identical assemblies is required, the modular design therefore cannot yield the aforementioned advantages here. Further disadvantages are that the assembly is hard to clean since it has a highly branched geometry. Noise-emitting components such as the electric motor are situated on the outer side, and for this reason the assembly can be loud. In particular, the modular design results in poor utilization of space and thus a large structural space. It is often the case that said assemblies are installed in machine tools. Here, compactness is of particular importance.

The applicant's printed data sheet "Spann- and Antriebsmodul Typ UPE 2 [Clamping and drive module type UPE 2]", number RD 51142, edition: 02.11, shows a clamping assembly of compact design. The disadvantage of this is that the electric motor is an oil-immersed motor, which causes splash losses and oil turbulence, and thus introduction of air in the oil. Furthermore, the oil-immersed motor transmits vibrations to the tank wall via the hydraulic oil as structure-borne sound, and for this reason such a compact assembly is also loud.

The applicant's printed data sheet "Antriebsmodul Typ UPE 5 [Drive module type UPE 5]", number RD 51145, edition: 06.12, shows an assembly in which the electric motor is surrounded by a tank. However, the pump is situated outside the tank and thus emits its sound in an undamped manner.

SUMMARY

By contrast, it is the object of the disclosure to provide a compact assembly in which the sound emissions from the drive unit are reduced.

Said object is achieved by a compact assembly according to this disclosure.

A compact electrohydraulic assembly according to this disclosure has a drive unit which has an electric motor and which has a hydrostatic pump, wherein pressure medium is able to be sucked out of a tank via the pump and delivered to a high-pressure-side consumer port. According to the disclosure, the tank has an inner wall which delimits an interior space which is separated from the pressure medium and thus dry and in which the electric motor is completely arranged and the pump is at least partially arranged. Consequently, splash losses and turbulence of the pressure medium, and thus introduction of air into the pressure medium, are avoided. In particular, the electric motor is completely encased and also the pump is at least partially encased, by the tank, with the result that the sound emissions from the drive unit are reduced.

Particularly good sound insulation can be achieved if the entire drive unit, that is to say the entire pump too, is encased by the tank.

As the only electric motor, use is advantageously made of a low-cost standard motor, which has for example a protection class IP22, since a higher protection class is achieved via the surrounding tank.

Further advantageous configurations of the disclosure are described in the description, drawings, and claims.

Preferably, the inner wall of the tank is spaced apart from the drive unit, this then resulting in a sound-insulating, circumferential spacing between the tank and the drive unit, which spacing, for example, can be filled with air in a simple manner in terms of apparatus.

Preferably, the tank has a cover to which the tank is fastened, and to which the drive unit is also fastened—preferably via a damping element, for example a cork plate. Preferably, electrical lines for the electric motor run through the cover.

In a particularly preferred refinement, the electric motor is fastened to the cover, and the pump is fastened to the electric motor, such that the electric motor is fastened on its side which is averted from the pump to the cover.

The tank is preferably produced from plastic in a cost-effective manner, for example as an injection-molded part or blow-molded part. The tank is thus quieter and less costly than the tank composed of aluminum of the last-mentioned prior art.

It is simple in terms of production if the inner wall is substantially circular-cylindrical, wherein the tank also has a substantially circular-cylindrical smooth outer wall. Consequently, the tank has a circular-ring-shaped cross section and is simple to clean.

Furthermore, the formation allows a circulating flow of the returning pressure medium and the degasification thereof to be achieved. Moreover, it is thus also possible for the utilization of the tank volume to be optimized.

According to a first variant, the two walls may be tube-like or tube-shaped and may be clamped between the cover and a base via at least one tie rod. The use of tubing available by the meter allows different tank sizes to be produced only via a variation of the length thereof and the length of the tie rods and the length of the compact assembly to be matched to electric motors of different length.

According to a second variant, the two walls may be formed integrally with a base. The tank is thus cup-like despite its inner space.

If the base is circular-ring-shaped, and if the cover is circular-ring-shaped or circular-disk-shaped, it is possible for the two walls, the base, the cover, and a central axis of the electric motor or of the entire drive unit to be concentric with respect to one another. Furthermore, if too the outer circumference of the electric motor or of the entire drive unit is substantially circular-cylindrical, the sound-insulating spacing to the inner wall of the tank can be minimized, and the compact assembly according to the disclosure can be formed to be as small as possible.

In a preferred refinement, there are provided in the tank plates via which the pressure medium is returned, said plates being able to absorb and dissipate the heat of the returning pressure medium.

The cooling of the pressure medium is particularly effective if the plates are connected in a heat-conducting manner via pressure-medium heat pipes or pressure-medium thermosiphons, which pass through the cover, to further plates which are arranged on a top side of the cover, which top side is averted from the tank. The further plates dissipate the heat directly to the ambient air. The pressure-medium heat pipes or pressure-medium thermosiphons serve for the cooling of the pressure medium and, for this purpose, are flowed over by, or dip into, the latter.

In the prior art, motor heat passes directly into the hydraulic oil. The maximum motor temperature is approximately 120° C., whereas the maximum oil temperature is 60° C. The heat dissipation capacity is directly proportional to the temperature difference between the respective component and the surroundings, and for this reason it is advantageous to dissipate the motor heat to the surroundings via natural or forced convection at a high temperature gradient instead of allowing the motor heat to flow into the pressure medium and, there, dissipating the heat to the ambient air at a lower temperature gradient. Consequently, effective cooling of the electric motor is realized if said motor is connected in a heat-conducting manner via motor heat pipes or motor thermosiphons, which pass through the cover, to further plates which are arranged on that side of the cover averted from the tank, preferably the top side of said cover. The further plates dissipate their heat directly to the ambient air. The motor heat pipes or motor thermosiphons serve for the cooling of the electric motor and, for this purpose, are connected in a heat-conducting manner thereto.

The further plates are preferably cooled by at least one fan. The latter—in contrast with the last-mentioned prior art—is driven independently of the rotational speed of the electric motor of the drive unit.

Alternatively, the electric motor may also have cooling fins which dissipate the motor heat to the air which flows through the spacing formed between the drive unit and the inner wall of the tank.

The cover may be a cooling plate or cold plate, which likewise absorbs and dissipates heat.

If the electric motor is provided with a supply electrically via a frequency converter with power electronics, the frequency converter or its power electronics is/are cooled particularly effectively if it is/they are fastened in a heat-conducting manner on the top side, averted from the tank, of the cooling plate to the latter. In this way, no control cabinet for the frequency converter is required, and the outlay for wiring is reduced in comparison with the prior art.

Alternatively, the frequency converter may also have a housing with cooling fins, and preferably a separate fan.

The frequency converter and the further plates together with the fan thereof may be accommodated in a housing. In this way, protection against dust and spray water is realized, and this can raise the protection class. Furthermore, it is possible for the housing to be formed such that the air of the fans is guided over the further plate packs and lateral escape of the air is prevented.

The central axes of the circular-cylindrical tank and of the electric motor preferably coincide and are oriented vertically, with the result that the compact assembly has a vertical structure.

BRIEF DESCRIPTION OF THE DRAWINGS

Several exemplary embodiments of a compact assembly according to the disclosure are illustrated in the drawings. The disclosure will now be discussed in more detail on the basis of the figures of said drawings.

In the figures.

DETAILED DESCRIPTION

Figure 1:
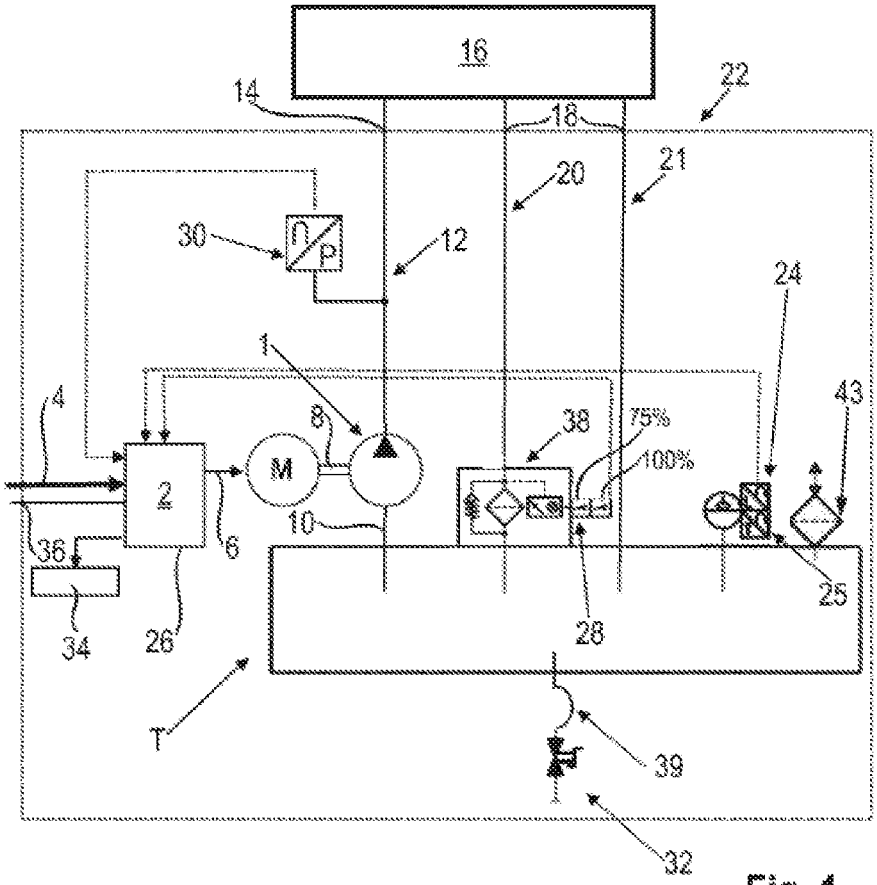
FIG. 1 shows a circuit diagram of a compact assembly according to the disclosure as per a first exemplary embodiment.

FIG. 1 shows a circuit diagram of the compact assembly according to the disclosure as per a first exemplary embodiment. The compact assembly has a drive unit with an electric motor M and with a hydrostatic pump 1. The electric motor M is operated by way of a frequency converter 2. The compact assembly also has a tank T for pressure medium, for example hydraulic oil.

The frequency converter 2 is provided between an electrical power supply 4 and an electrical line 6, with the result that the electric motor M is provided with a supply via the electrical line 6 in a frequency-regulated and thus rotational-speed-regulated manner. In this way, the pump 1 is driven, with variable rotational speed, by the electric motor M via a shaft 8. In the process, the pump 1 sucks pressure medium out of the tank T via a suction line 10 and delivers said medium via a pressure or feed line 12 to a high-pressure-side consumer port 14 of the compact assembly. A consumer, which may be for example a cylinder, is connected to this consumer port 14 via valves. The consumer and the valves are illustrated merely symbolically and form a hydraulic system 16.

The pressure medium flows from the consumer 16 back into the compact assembly via a low-pressure-side consumer port 18. More specifically, the pressure medium flows from the consumer port 18 to the tank T via a first return line 20 and via a second return line 21, wherein a return filter 38 is provided in the first return line 20. In the case of machine tools, two return lines 20, 21 are normally required. One which withstands a back pressure caused by the return filter 38, and a further one which runs into the tank T without back pressure. Here, a leakage port of a rotary leadthrough is connected at the machine tool spindle. The pressure medium which flows to the tank T in the rotary leadthrough must not have any backing up of pressure medium and is guided without pressure into the tank T down a slope.

All the components arranged within an assembly boundary 22 are situated on or in the compact assembly, and all the crossing lines are led out via interfaces (plug connections in the case of electrics, and hydraulic connections in the case of the pressure line or feed line 12 to a consumer and return lines 20, 21 from the consumer).

The pressure p in the feed line 12 is measured via a pressure sensor 30 which is as close to the pump as possible, and the signal is transmitted to the frequency converter 2 with an integrated PID regulator for constant pressure regulation. This then regulates the frequency of the power supply to the electric motor M via the line 6. In this way, it is achieved that the pressure in the feed line 12 is kept constant in accordance with the volume flow in the feed line 12, which is determined by the hydraulic system 16. If the hydraulic system 16 requires more volume flow, for example because its consumer has to be moved very quickly, the frequency converter 2 speeds up the drive unit according to the regulation loop (pressure sensor—frequency converter—electric motor—pump) and keeps the pressure p constant.

In addition, a fill level sensor 24, a temperature sensor 25 for the pressure medium and a filter soiling sensor 28 for the return filter 38 are provided. Said sensors are electrically linked to an I/O board which is integrated in a housing 26 of the frequency converter 2. Said signals are used for example for an emergency off in the case of too low a pressure medium level, too high a temperature and a soiled return filter 38. Optionally, the sensors 24, 25, 28 are evaluated in an analog manner or have warning functions which are triggered at defined threshold values. The frequency converter 2 is able to output the warnings, for example via an optical indicator such as a (yellow illuminating) LED 34. An emergency off signal can be indicated via the (red illuminating) LED 34, and fault-free operation can be indicated via the (green illuminating) LED 34.

Furthermore, the signals of the sensors 24, 25, 28 may be transmitted in a bundled manner to a higher-level interface (for example of a controller of the machine tool which is provided with a supply by the compact assembly) via a data interface 36 which is analog (for example 4-20 mA, 0-10 V), digital (low-high) or a bus interface.

A drainage device 32, which may be designed for example as a ball valve, is furthermore provided at the compact assembly. A transparent hose which serves as a fill level indicator 39 is installed between the tank T and the drainage device 32. In order to monitor the fill level in the tank T, the drainage device 32 is held on the top side of the compact assembly and in particular of the tank T, and is opened there so that the fill level in the tank T can be indicated via the hose (communicating vessels). Ideally, the drainage device 32 is opened on the top side of the tank T while attached in the interior space thereof so that introduction of dirt by way of the ambient air is prevented. An inlet and aeration filter 43 is also provided at the tank T.

Figure 2:
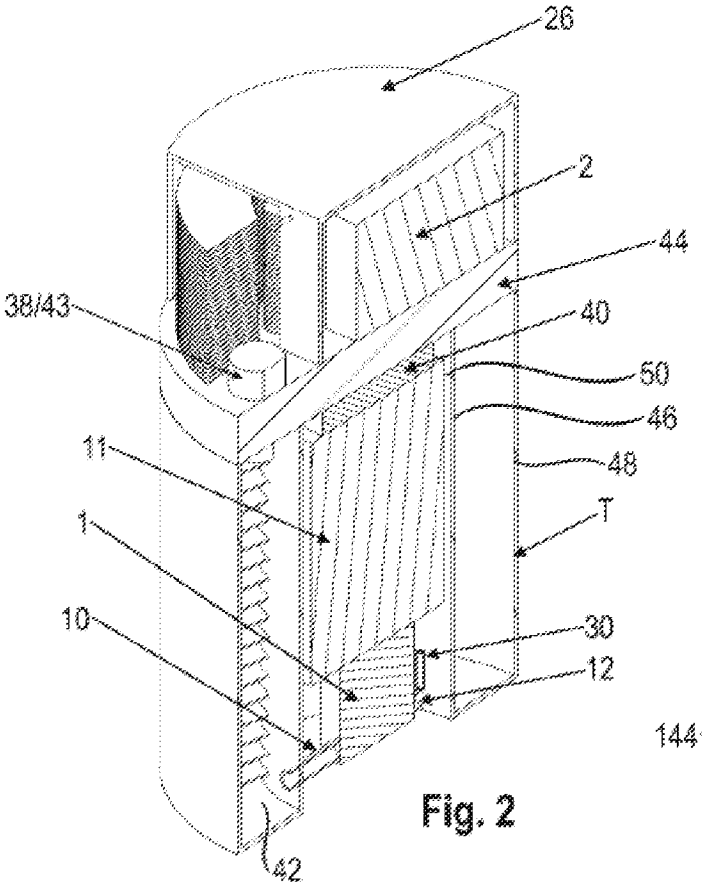
FIG. 2 shows, in a perspective longitudinal section, a compact assembly according to the disclosure as per a second exemplary embodiment.

FIG. 2 shows, in a perspective longitudinal section, a compact assembly according to the disclosure as per a second exemplary embodiment. The internal electric motor M with a directly flanged-on pump 1 is illustrated. The drive unit thus formed is surrounded by the ring-shaped tank T, which is preferably produced from plastic, for example by means of an injection molding process. The pump 1 sucks pressure medium from a lower region of the tank T via the suction line 10, which extends in the radial direction between the tank T and the pump 1, and discharges said medium at a relatively high pressure level via the feed line 12 to the following hydraulic system 16 (neither being shown in FIG. 2, cf. FIG. 1). After passing through the hydraulic system and releasing hydraulic energy, the pressure medium passes back into the tank T via a return bore and via the return lines 20, 21 (neither being shown in FIG. 2, cf. FIG. 1).

Preferably, the drive unit is installed vertically and is suspended in a vibration-damping manner, via a damping element 40 (for example a cork plate), on a cover 44 by way of assembly screws (not shown). Furthermore, vibration-damping elements (not shown), such as for example plastic sleeves, are also provided between the assembly screws and the cover 44. The cover 44 delimits the upper region of the tank T and closes it off.

The tank T has an inner wall 46 and an outer wall 48 which are concentric with respect to one another and between which a circular-ring-shaped base 42 is integrally formed. The tank T is thus cup-like and has a circular-ring-shaped cross section with an interior space. The cover 44 is circular-disk-shaped, and the housing 26 of the frequency converter 2 has a circular-cylindrical shape. The outer wall 48 of the tank T, and the cover 44 and the housing 26 have an approximately equal diameter, and so the compact assembly has a circular-cylindrical shape overall.

Provided between the inner wall 46 of the tank T and the drive unit, in particular the electric motor M of the latter, is a circumferential spacing 50 which is filled with ambient air. In this way, the emitted noise of the drive unit and thus of the compact assembly is dampened.

It is possible via an aeration device, such as for example a bore or the inlet and aeration filter 43 integrated in the cover 44, possibly in combination with a filling device (filling and deaeration filter ELF), for air to be drawn from the surroundings into the tank T for the purpose of replenishment, or discharged to the surroundings, in the case of an oscillating volume due to the hydraulic system 16.

The electric motor M is supplied with electrical energy by means of the electrical line 6 (cf. FIG. 1). The latter is led through a bore in the cover 44 from the frequency converter 2 arranged on the top side of the cover 44 to the electric motor M on the bottom side of the cover 44.

Figure 3:
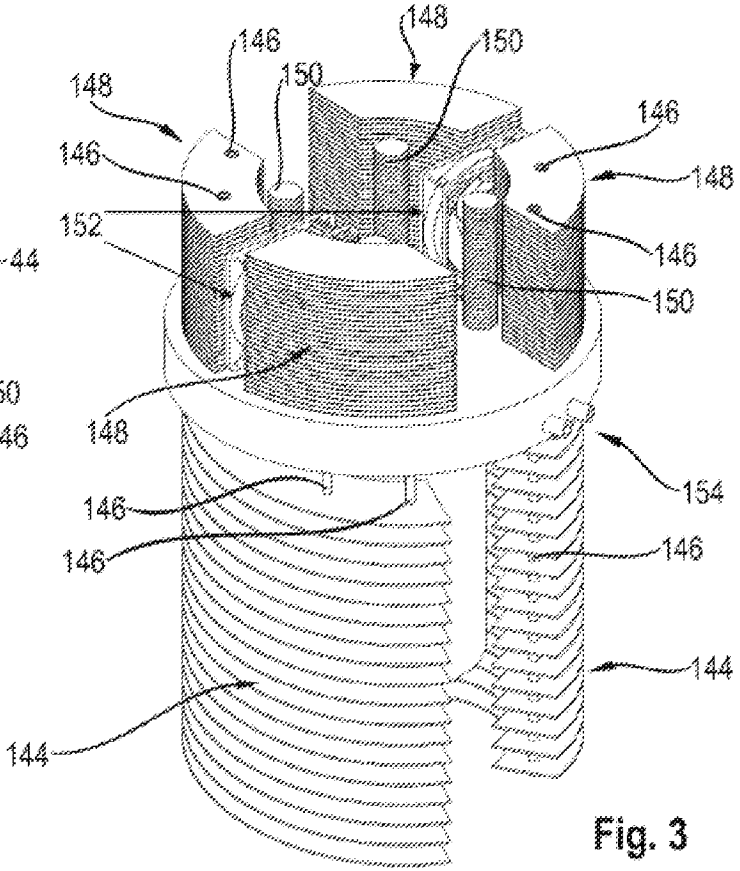
FIG. 3 shows, in a perspective view, some components of the compact assembly from FIG. 2.

FIG. 3 shows the second exemplary embodiment of the compact assembly according to the disclosure from FIG. 2, wherein the pump 1, the tank T, the frequency converter 2 and the housing 26 have been omitted. The cooling means of the second exemplary embodiment of the compact assembly according to the disclosure is thus able to be seen. Arranged in the tank T are two plate packs 144 which each consist of a plurality of semicircular-arc-shaped plates. All the plates are connected in a heat-conducting manner to further plate packs 148 via respective pressure-medium heat pipes 146 which extend through the cover 44 to the top side, averted from the tank T, of the cover 44. For each tank-side plate pack 144, there are provided two further plate packs 148 whose plates are approximately quadrant-shaped.

Furthermore, the electric motor M is also connected in a heat-conducting manner to further plate packs 150 via four motor heat pipes (not shown) which extend through the cover 44 to the top side, averted from the electric motor M, of the cover 44.

Consequently, the waste heat of the returning pressure medium and of the electric motor M to the further plate packs 148, 150 is transported to the top side, averted from the tank T and from the electric motor M, of the cover 44 and, from there, dissipated via the further plate packs 148, 150 there to the ambient air. Additionally, it is possible for (for example two) fans 152 to be provided between the further plate packs 148, 150.

The cover 44 is formed as a cooling plate, and a cooling-water duct, of which only the two ports 154 can be seen, passes through said plate.

Figure 5:
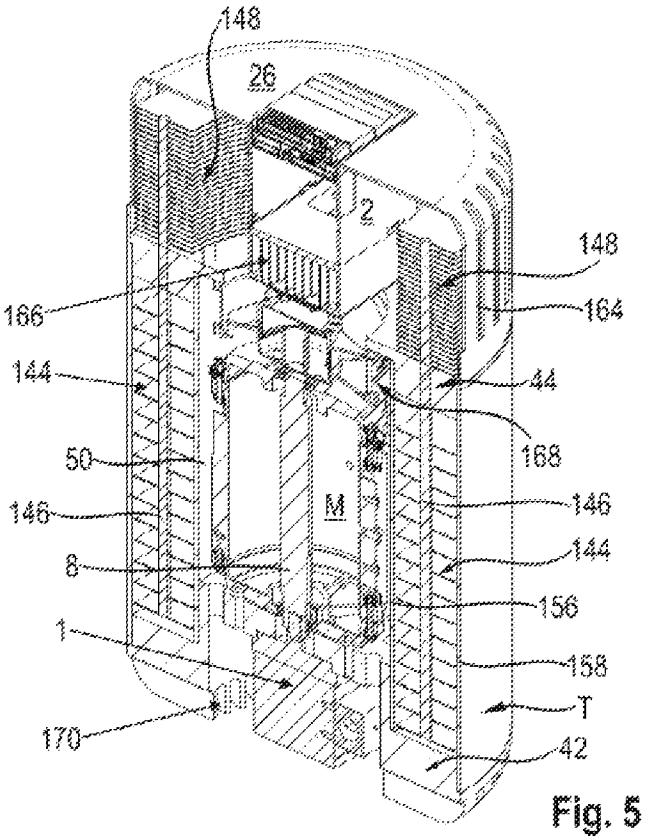
FIG. 5 shows, in a further perspective longitudinal section, the compact assembly from FIG. 4.
Figure 4:
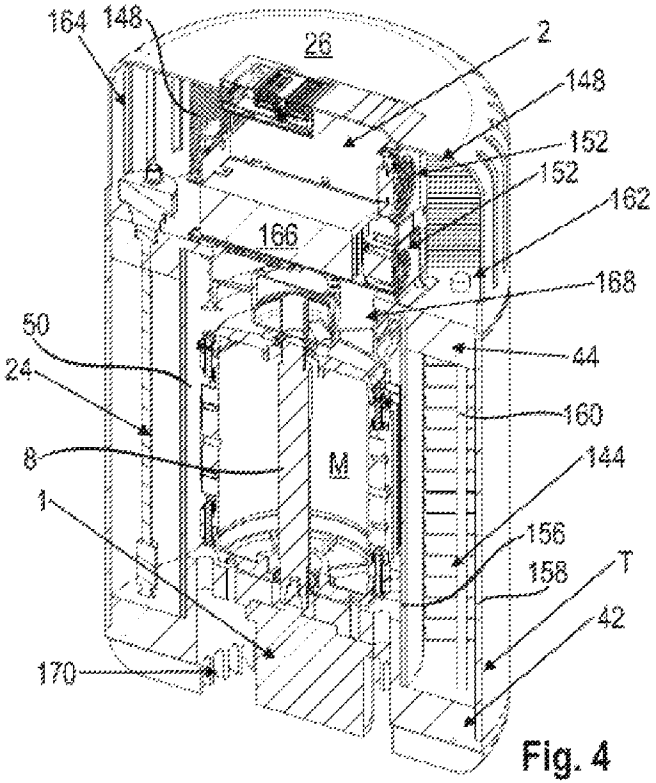
FIG. 4 shows, in a perspective longitudinal section, a compact assembly according to the disclosure as per a third exemplary embodiment.

FIGS. 4 and 5 each show, in a sectioned perspective view, a third exemplary embodiment of the compact assembly according to the disclosure, wherein the section planes of the two figures are rotated through 90 degrees with respect to one another.

In the third exemplary embodiment, the tank T is formed by an inner tube 156, an outer tube 158, the base 42 and the cover 44. The cover 44 and the base 42 are connected by tie rods 160 with respective tie-rod bolts 162, wherein the two tubes 156, 158 are clamped between the base 42 and the cover 44.

Additionally, in the third exemplary embodiment, the cooling means is slightly changed in relation to the second exemplary embodiment. The frequency converter 2 is cooled with its power electronics via (for example two) separate fans 152 which draw in an air volume flow through aeration slots 164 of the housing 26, cool the frequency converter 2 and its power electronics by means of flow through the interior space and flow through its cooling body 166, and exit the housing 26 again through the aeration slots 164.

The electric motor M is cooled via a fan 168 which is integrated in the interior space of the compact assembly or of the tank T and which is arranged concentrically with respect to the electric motor M. The fan 168 likewise draws in air through the aeration slots 164 of the housing 26, firstly cooling the pressure medium via the further plate packs 148 which are arranged on the outer circumference of the cover 44 and which are connected to the plate packs 144 of the tank T by means of pressure-medium heat pipes 146, and subsequently cooling the electric motor M via the cooling fins thereof. The warm air finally exits the compact assembly again in a radial direction via aeration slots 170 on an underside of the base 42. The fan 168 may also be installed directly on the shaft 8.

Disclosed is a compact hydrostatic assembly with an electric motor and with a pump which delivers pressure medium from a tank to a consumer port. The tank is circular-ring-shaped, and the electric motor and the pump are jointly surrounded by said tank.

LIST OF REFERENCE SIGNS

1 Pump
2 Frequency converter
4 Electrical power supply
6 Electrical line
8 Shaft
10 Suction line
12 Feed line
14 High-pressure-side consumer port
16 Hydraulic system (consumer with valves)
18 Low-pressure-side consumer port
20 First return line
21 Second return line
22 Assembly boundary
24 Fill level sensor
25 Temperature sensor
26 Housing
28 Filter soiling sensor
30 Pressure sensor
32 Drainage device
34 LED
36 Data interface
38 Return filter
39 Fill level indicator
40 Damping element
42 Base
43 Inlet and aeration filter
44 Cover
46 Inner wall
48 Outer wall
50 Spacing
144 Plate pack
146 Pressure-medium heat pipe
148 Further plate pack
150 Further plate pack
152 Fan
154 Ports
156 Inner tube
158 Outer tube
160 Tie rod
162 Tie-rod bolt
164 Aeration slot
166 Cooling body
168 Fan
170 Aeration slot
p Pressure
M Motor
T Tank

The invention claimed is:

1. A compact electrohydraulic assembly, comprising:
a tank configured to store a pressure medium, and including an inner wall that delimits an interior space that is separated from the pressure medium; and
a drive unit including:
an electric motor; and
a hydrostatic pump configured to suck pressure medium out of the tank,
wherein the electric motor and the pump are positioned in the interior space of the tank.

2. The compact assembly as claimed in claim 1, wherein the drive unit is spaced apart from the inner wall.

3. The compact assembly as claimed in claim 1, further comprising a cover fastened to the tank and the drive unit.

4. The compact assembly as claimed in claim 3, further comprising:
a further plate pack positioned on a side of the cover facing away from the tank; and
motor heat pipes that pass through the cover, and that connect, in a heat-conducting manner, the electric motor to the further plate pack.

5. The compact assembly as claimed in claim 3, wherein the cover is a cooling plate.

6. The compact assembly as claimed in claim 5, further comprising:
a frequency converter fastened to a side of the cooling plate facing away from the tank, and configured to supply the electric motor with a supply electrically.

7. The compact assembly as claimed in claim 1, wherein the tank is formed from plastic.

8. The compact assembly as claimed in claim 1, wherein:
the inner wall has a substantially circular-cylindrical shape; and
the tank further includes an outer wall having a substantially circular-cylindrical shape.

9. The compact assembly as claimed in claim 8, further comprising:
a cover fastened to the drive unit and to the tank; and
a base
wherein either (i) the inner wall and the outer wall are clamped between the cover and the base via at least one tie rod, or (ii) the inner wall and the outer wall are formed integrally with the base.

10. The compact assembly as claimed in claim 9, wherein:
the base has a circular ring-like shape;
the cover has a circular ring-like shape or a circular disk-like shape; and
the inner wall, the outer wall, the base, the cover, and a central axis of either the electric motor or of the drive unit are concentric with respect to each other.

11. The compact assembly as claimed in claim 1, wherein the tank further includes a plate pack configured to guide the pressure medium.

12. The compact assembly as claimed in claim 11, further comprising:

a cover fastened to the drive unit and to the tank;

a further plate pack positioned on a side of the cover facing away from the tank; and a plurality of pressure-medium heat pipes that pass through the cover, and that connect, in a heat conducting manner, plates of the plate pack to the further plate pack.

* * * * *